US005885762A

United States Patent [19]

Maskasky et al.

[11] Patent Number: 5,885,762

[45] Date of Patent: Mar. 23, 1999

[54] HIGH CHLORIDE TABULAR GRAIN EMULSIONS AND PROCESSES FOR THEIR PREPARATION

[75] Inventors: Joe E. Maskasky; Victor P. Scaccia, both of Rochester; Samuel Chen, Penfield, all of N.Y.

[73] Assignee: Eastman Kodak Company, Rochester, N.Y.

[21] Appl. No.: 955,867

[22] Filed: Oct. 21, 1997

[51] Int. Cl.[6] ..... G03C 1/035

[52] U.S. Cl. ..... 430/567; 430/569

[58] Field of Search ..... 430/567, 569

[56] References Cited

U.S. PATENT DOCUMENTS

| | | | |
|---|---|---|---|
| 4,399,215 | 8/1983 | Wey | 430/567 |
| 4,400,463 | 8/1983 | Maskasky | 430/434 |
| 4,433,048 | 2/1984 | Solberg et al. | 430/434 |
| 4,434,226 | 2/1984 | Wilgus et al. | 430/567 |
| 4,439,520 | 3/1984 | Kofron et al. | 430/434 |
| 4,806,461 | 2/1989 | Ikeda et al. | 430/567 |
| 5,068,173 | 11/1991 | Takehara et al. | 430/567 |
| 5,275,930 | 1/1994 | Maskasky | 430/567 |
| 5,292,632 | 3/1994 | Maskasky | 430/567 |
| 5,314,798 | 5/1994 | Brust et al. | 430/567 |
| 5,320,938 | 6/1994 | House et al. | 430/567 |
| 5,358,842 | 10/1994 | Kasai et al. | 430/569 |
| 5,413,904 | 5/1995 | Chang et al. | 430/569 |
| 5,472,836 | 12/1995 | Haga | 430/567 |
| 5,550,012 | 8/1996 | Suga | 430/567 |
| 5,550,014 | 8/1996 | Maruyama et al. | 430/567 |
| 5,663,041 | 9/1997 | Chang et al. | 430/569 |
| 5,665,530 | 9/1997 | Oyamada et al. | 430/567 |
| 5,672,467 | 9/1997 | Buitano et al. | 430/363 |
| 5,707,793 | 1/1998 | Oyamada | 430/567 |
| 5,792,602 | 8/1998 | Maskasky et al. | 430/569 |

FOREIGN PATENT DOCUMENTS 0 670 515 A2 9/1995 European Pat. Off. .

OTHER PUBLICATIONS

G.C. Farnell, R.B. Flint & J.B. Chanter, "Preferred Sites for Latent–Image Formation", *J. Photogr. Sci.*, 13:25(1965).

J.F, Electron–Microscope Study of Defect Structure and Photolysis in Silver Bromide Microcrystals:, *Photogr. Sci. Eng.*, 11:57(1967).

G.C. Farnell, R.L. Jenkins & L.R. Solman, Grain Disorder and its Influence on Emulsion Response:, *J. Photogr. Sci.*, 24:1(1976).

*Primary Examiner*—Mark F. Huff
*Attorney, Agent, or Firm*—Carl O. Thomas

[57] ABSTRACT

Photographically useful radiation-sensitive high chloride {100} tabular grain emulsions containing iodide are disclosed. A high proportion of the {100} tabular grains contain crystal lattice dislocations extending inwardly from their peripheral edges. The dislocations are created by introducing elemental iodine into a high chloride {100} tabular grain emulsion, reducing the iodine to iodide, displacing chloride ions at the peripheral edges of the tabular grains with iodide ions, and then continuing growth of the high chloride {100} tabular grains. The dislocations in the peripheral and, particularly, corner regions of the tabular grains increase their sensitivity.

11 Claims, 3 Drawing Sheets

HIGH CHLORIDE TABULAR GRAIN EMULSIONS AND PROCESSES FOR THEIR PREPARATION

FIELD OF THE INVENTION

The invention relates to radiation-sensitive silver halide emulsions useful in photographic and radiographic imaging and to processes for their preparation.

DEFINITION OF TERMS

In referring to grains and emulsions containing two or more halides, the halides are named in order of ascending concentrations.

The term "high chloride" or "high bromide" in referring to grains and emulsions indicates that chloride or bromide, respectively, is present in a concentration of greater than 50 mole percent, based on total silver.

The term "equivalent circular diameter" or "ECD" is employed to indicate the diameter of a circle having the same projected area as a silver halide grain.

The term "equivalent circular radius" or "ECR" is employed to indicate the radius of a circle having the same projected area as a silver halide grain.

The term "aspect ratio" designates the ratio of grain ECD to grain thickness (t).

The term "tabular grain" indicates a grain having two parallel crystal faces which are clearly larger than any remaining crystal face and having an aspect ratio of at least 2.

The term "tabular grain emulsion" refers to an emulsion in which tabular grains account for greater than 50 percent of total grain projected area.

The term "{100} tabular" or "{111} tabular" is employed in referring to tabular grains and tabular grain emulsions to indicate tabular grains having major faces lying in {100} or {111} crystal planes, respectively.

The term "dislocation" refers to a crystal lattice defect that can be observed by microscopic examination of a tabular grain major face.

The term "peripheral region" in referring to a tabular grain indicates that portion of the grain between its major faces extending inwardly from the peripheral edges of the major faces by a distance amounting to 10 percent of the ECR of the tabular grain.

The term "corner region" indicates that portion of the peripheral region that lies in the vicinity of the corner of a {100} tabular grain as viewed perpendicular to one major face.

A better visualization of the peripheral and corner regions as well as the quantification of their limits can be appreciated by reference to FIG. 3, wherein a {100} tabular grain T is shown as viewed perpendicular to one major face. The grain has a peripheral boundary E. The peripheral boundary is in part linear and in part curved in the vicinity of the grain comers. Linear extrapolations of the linear portions of the peripheral boundary X1, X2, X3 and X4 intersect at points C1, C2, C3 and C4. Diagonal D1 extends between points C1 and C3. Diagonal D2 extends between points C2 and C4. The diagonals intersect at point A, which is the center of both the {100} major face of the tabular grain and the center of a circle C having an area equal to the projected area of the grain within the peripheral boundary. ECR extending between A and C is the equivalent circular radius of the grain. The peripheral region PR extends between the outer edge E of the grain and boundary B spaced inwardly from E by a distance amounting to 10 percent of ECR. The portion of the grain lying within the boundary B is the central region of the grain. The comer regions CR1, CR2, CR3 and CR4 are those four portions of the peripheral region that each lie within the peripheral region within an arc F swung from the intersection of E with a diagonal, the arc having a radius R that is 25 percent of the distance between adjacent intersection points (e.g., between C1 and C4 or C1 and C2). When the distance between C1 and C4 differs from the distance between C1 and C2, the two are averaged in arriving at R. As shown all of the grains are equally rounded in the vicinity of each corner. However, the definition above applies equally when the grains are unequally rounded in the vicinity of their corners.

The term "vAg" indicates the potential difference in volts between a standard reference electrode (Ag/AgCl with 4 molar KCl at room temperature) in a 4 molar KCl salt bridge and an anodized Ag/AgCl indicator electrode.

*Research Disclosure* is published by Kenneth Mason Publications, Ltd., Dudley House, 12 North St., Emsworth, Hampshire P010 7DQ, England.

BACKGROUND

Marked improvements in the performance of photographic emulsions began in the 1980's, resulting from the introduction of tabular grain emulsions into photographic products. A wide range of photographic advantages have been provided by tabular grain emulsions, such as improved speed-granularity relationships, increased covering power (both on an absolute basis and as a function of binder hardening), more rapid developability, increased thermal stability, increased separation of native and spectral sensitization imparted imaging speeds, and improved image sharpness in both mono- and multi-emulsion layer formats.

Although tabular grain emulsions can be selected to provide a variety of performance advantages, depending upon the photographic application to be served, initially commercial interest focused on achieving the highest attainable photographic speeds with minimal attendant granularity. This capability of high bromide {111} tabular grain emulsions was demonstrated by Wilgus et al U.S. Pat. No. 4,434,226 and Kofron et al U.S. Pat. No. 4,439,520. It was, of course, recognized that minor amounts of iodide further improve the speed-granularity relationship, and Solberg et al U.S. Pat. No. 4,433,048 taught that increased iodide concentrations near the peripheral edge of the tabular grains further improved the speed-granularity relationship.

Sometime after silver iodobromide {111} tabular grain emulsions appeared in photographic film products Ikeda et al U.S. Pat. No. 4,806,461 microscopically examined high bromide {111} tabular grains and concluded their superior speed-granularity could be attributed in part to the presence of 10 or more dislocations in tabular grains accounting for at least 50 percent of total grain projected area. This observation was reiterated by Takehara et al U.S. Pat. No. 5,068,173, Haga et al U.S. Pat. No. 5,472,836, Suga et al U.S. Pat. No. 5,550,012, and Maruyama et al U.S. Pat. No. 5,550,014. Before tabular grain emulsions were commercially used and before the observations of Ikeda et al, dislocations had been observed in high bromide {111} tabular grains and postulated to facilitate latent image formation, as illustrated by G. C. Farnell, R. B. Flint and J. B. Chanter, "Preferred Sites for Latent-Image Formation", *J. Photogr. Sci.*, 13:25(1965); J. F. Hamilton, "Electron-Microscope Study of Defect Structure and Photolysis in Silver Bromide Microcrystals", *Photogr. Sci. Eng.*, 11:57 (1967); and G. C. Farnell, R. L. Jenkins and L. R. Solman, "Grain Disorder and its Influence on Emulsion Response", *J. Photogr. Sci.*, 24:1(1976).

Black et al U.S. Pat. No. 5,709,988 discovered that the crystal lattice dislocations in the central region of high bromide {111} tabular grains increase pressure sensitivity while the crystal lattice dislocations in the peripheral region of the tabular grains increase sensitivity without increasing pressure sensitivity.

The first high chloride tabular grain emulsions contained {111} tabular grains, as illustrated by Wey U.S. Pat. No. 4,399,215 and Maskasky U.S. Pat. No. 4,400,463. Maskasky U.S. Pat. Nos. 5,292,632 and 5,275,930 overcame the problem of high chloride {111} tabular grain morphological instability by providing the first high chloride {100} tabular grain emulsions. The combination of the known ecological and developability advantages of high chloride emulsions with the higher tabular shape stability of high chloride grains with {100} crystal faces has stimulated interest in high chloride {100} tabular grain emulsions.

Several forms of incorporation of iodide into high chloride {100} tabular grains have been investigated. House et al U.S. Pat. No. 5,320,938, Chang et al U.S. Pat. No. 5,413,904, and Saito EPO 0 670 515 realized advantages to be obtained when iodide is added at or near grain nucleation.

Brust et al U.S. Pat. No. 5,314,798 observed a speed increase without an offsetting granularity increase when a band of higher iodide content is grown onto a high chloride {100} tabular grain. Potassium iodide is the demonstrated source of iodide during band formation. Chang et al U.S. Pat. No. 5,663,041 is cumulative with Brust et al.

Maskasky, Scaccia and Chen U.S. Pat. No. 5,792,602 discloses a process of preparing iodohalide grains wherein iodide ion is introduced into the crystal lattice structure by introducing elemental iodine into the dispersing medium and maintaining the dispersing medium within a pH range of from 5 to 8.

SUMMARY OF THE INVENTION

This invention is directed to high chloride {100} tabular grain emulsions exhibiting increased sensitivity. It has been discovered quite unexpectedly that the introduction of elemental iodine during growth forming a peripheral region of the {100} tabular grains creates a high proportion of crystal lattice dislocations extending inwardly from the peripheral edges of the high chloride {100} tabular grains.

The dislocation pattern, though observed previously in high bromide {111} tabular grain emulsions, has not been achieved prior to this invention in high chloride {100} tabular grain emulsions. When conventional approaches for iodide incorporation into the peripheral region of high chloride {100} tabular grains have been employed—those that provide iodide ions, either as soluble iodide salts or by releasing iodide ions from silver iodide grains by Ostwald ripening, a comparable dislocation pattern is not produced.

In one aspect, this invention is directed to a radiation-sensitive emulsion comprised of a dispersing medium and radiation-sensitive silver halide grains wherein the radiation-sensitive silver halide grains contain greater than 50 mole percent chloride, based on silver, greater than 50 percent of total grain projected area is accounted for by tabular grains having parallel {100} major faces extending to their peripheral edges, and greater than 10 percent of the tabular grains having {100} major faces include in an iodide containing peripheral region 10 or more crystal lattice dislocations extending inwardly from peripheral edges of the {100} major faces.

In another aspect, the invention is directed to a process of preparing a tabular grain emulsion comprised of the steps of (1) providing an emulsion comprised of a dispersing medium and radiation-sensitive silver halide host grains in which (i) the radiation-sensitive silver halide host grains contain greater than 50 mole percent chloride, based on silver, and (ii) greater than 50 percent of host grain projected area is accounted for by host tabular grains having parallel {100} major faces, and (2) extending lateral growth of the {100} major surfaces of the tabular grains by precipitating additional silver halide containing greater than 50 mole percent chloride, based on silver, to form tabular grains with {100} major faces extending to peripheral edges of the tabular grains, wherein, prior to step (2), (a) elemental iodine is introduced into the dispersing medium, (b) the iodine is converted to iodide, and (c) the iodide is incorporated into the tabular grains at their peripheral edges by chloride ion displacement, to create in step (2) 10 or more crystal lattice dislocations extending inwardly from the peripheral edges of greater than 10 percent of the tabular grains having {100} major faces.

DESCRIPTION OF PREFERRED EMBODIMENTS

Figure 1:
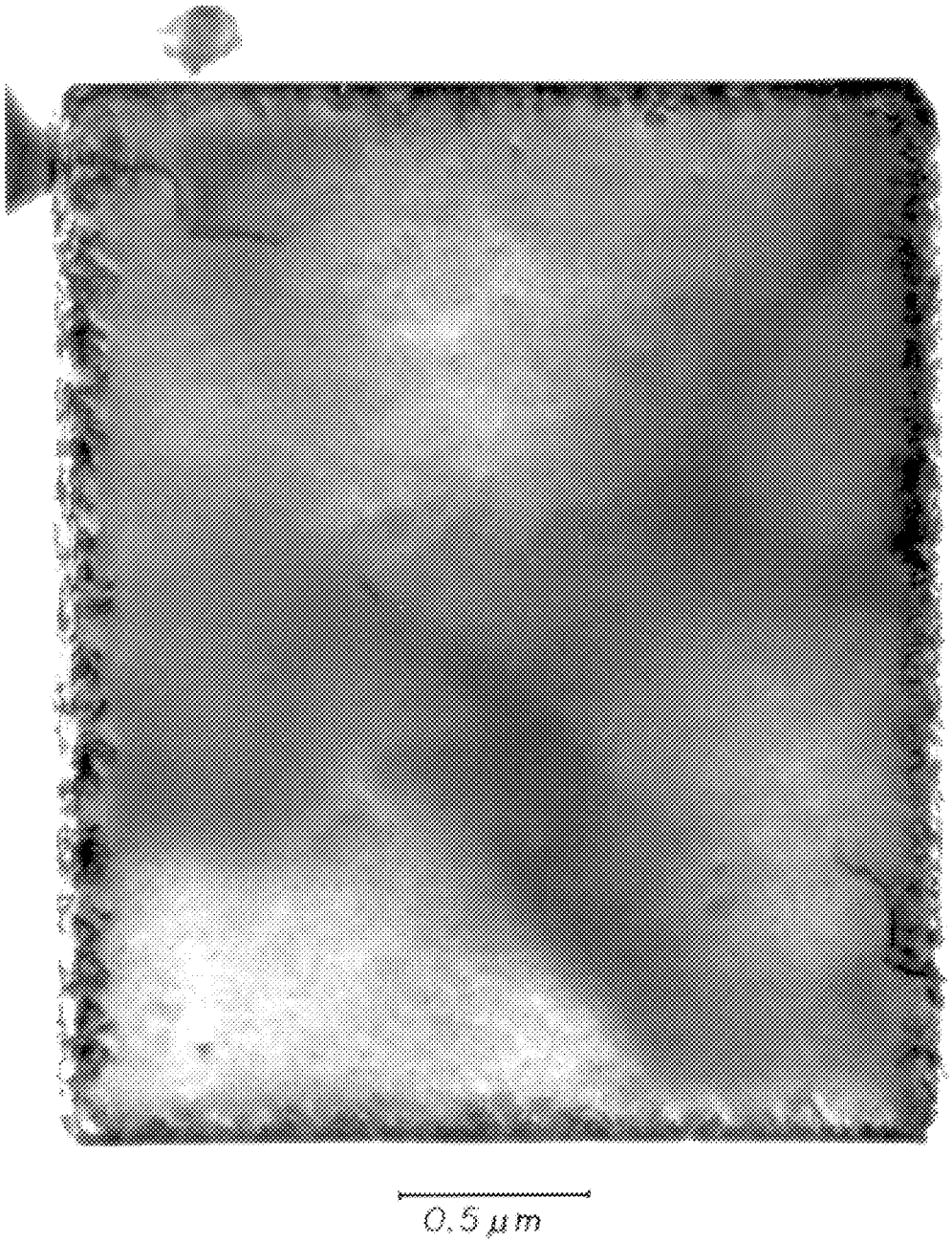
FIGS. 1 and 2 are transmission electron micrographs of representative high chloride {100} tabular grains within emulsions prepared according to this invention.

The emulsions of the invention can be prepared by starting with and then modifying during further growth any conventional high chloride {100} tabular grain emulsion. Examples of starting emulsions and their preparation are provided by the following patents (hereinafter referred to as the starting emulsion patents), the disclosures of which are here incorporated by reference:

| | |
|---|---|
| Maskasky | U.S. Pat. No. 5,292,632; |
| House et al | U.S. Pat. No. 5,320,938; |
| Saitou et al | U.S. Pat. No. 5,652,089; |
| Maskasky | U.S. Pat. No. 5,264,337; |
| Brennecke | U.S. Pat. No. 5,498,518; |
| Chang et al | U.S. Pat. No. 5,413,904; |
| Brust et al | U.S. Pat. No. 5,314,798; |
| Olm et al | U.S. Pat. No. 5,457,021; |
| Oyamada | U.S. Pat. No. 5,593,821; |
| Oikawa | U.S. Pat. No. 5,654,133; |
| Saitou et al | U.S. Pat. No. 5,587,281; |
| Yamashita | U.S. Pat. No. 5,565,315; |
| Yamashita et al | U.S. Pat. No. 5,641,620; |
| Yamashita et al | U.S. Pat. No. 5,652,088; and |
| Chang et al | U.S. Pat. No. 5,663,041 |

By definition the starting high chloride {100} tabular grain emulsions (i) contain greater than 50 mole percent chloride, based on silver and (ii) have greater than 50 percent of total grain projected area accounted for by tabular grains having an aspect ratio of at least 2.

The starting emulsions preferably contain greater than 70 mole percent chloride, based on silver, and optimally greater than 90 mole percent chloride, based on silver. The remaining halide, if any, can be bromide and/or iodide. It is preferred to limit iodide concentrations to less than 10 (most preferably less than 5) mole percent, based on silver. When iodide is employed at or near grain nucleation solely for inducing tabular grain growth, amounts of iodide as low as 0.001 (preferably 0.01) mole percent iodide have been shown to be sufficient to provide {100} tabular grains. Contemplated silver grain compositions include silver chloride, silver iodochloride, silver bromochloride, silver iodobromochloride and silver bromoiodochloride.

The tabular grains preferably account at least 70 percent of total grain projected area and optimally at least 90 percent of total grain projected area. The tabular grains preferably have an average aspect ratio of at least 5 and most preferably greater than 8. The tabular grains preferably have an average thickness of less than 0.3 μm and most preferably less than 0.2 μm. Ultrathin tabular grain emulsions, those in which the tabular grains have an average thickness of less than 0.07 μm, are specifically contemplated.

It is generally preferred to choose starting high chloride {100} tabular grain emulsions having the highest conveniently realized proportion of the total high chloride grain population accounted for by {100} tabular grains while also having the lowest conveniently realized average thickness of the tabular grains.

The average aspect ratio of the {100} tabular grains is limited by the average grain ECD desired in the emulsion prepared from the starting emulsion. With minimum amounts of silver addition in the process of the invention the starting emulsion can have a mean grain ECD that is not significantly different from that of the product emulsion. The maximum increase in mean grain ECD in the product emulsion occurs when a maximum amount of silver is introduced in the growth step of the invention and all or substantially all of the growth occurs at the edges of tabular grains. In the case of tabular grains the percent increase in average grain projected area (PA) is the same as the percent additional silver added. Using the formula:

$$PA=\pi(ECR)^2 \quad (I)$$

the degree to which the mean grain ECD (ECR X 2) in the starting emulsion must be reduced below the desired mean grain ECD in the product emulsion can be calculated.

The first step, step (1), of the process of the invention is to provide a high chloride {100} tabular grain emulsion as described above. The second step, step (2), is to continue growth onto the peripheral edges of the {100} tabular grains while introducing crystal lattice dislocations. Prior to step (2), three successive steps occur: In step (a) elemental iodine is introduced into the dispersing medium. In step (b) the iodine is converted to iodide, and in step (c) the iodide is incorporated into the tabular grains at their peripheral edges by displacement of chloride ions.

Step (a) begins with the starting high chloride {100} tabular grain emulsion in a reaction vessel. This can be the reaction vessel in which starting emulsion of step (1) has been grown and in which the further tabular grain growth of step (2) also occurs. Before proceeding to step (2), elemental iodine is introduced into the dispersing medium dissolved in a water miscible solvent, such as methyl or ethyl alcohol or dimethylformamide.

Iodine can be introduced in any amount sufficient to introduce the desired concentration of crystal lattice dislocations. In selecting an iodine amount for incorporation, consideration must be given to the probability that a small amount of iodine will escape as a vapor from the reaction medium. Generally iodine addition in a concentration of at least 0.1 (preferably 0.2) mole percent, based on silver introduced in step (1), is contemplated. There is no necessity for increasing iodine concentrations above 5 mole percent, based on step (1) silver addition, in order to achieve a sensitizing concentration of peripheral crystal lattice dislocations. It is, in fact, preferred to limit iodine addition to 4 mole percent or less, based on step (1) silver addition. The purpose in limiting iodine addition is to avoid achieving such a high level of crystal lattice dislocations that the tabular character of the grains is put at risk. However, it must be borne in mind that the iodine additions result in lower peak iodide levels than suggested by the percentages indicated above, since the iodide in the grains resulting from iodine addition is in its final placement present in portions of the high chloride {100 } grains formed both before and after iodine addition.

In step (b) elemental iodine (I°) introduced in step (a) is converted to iodide ion (I). Step (b) occurs spontaneously after commencing iodine addition to the dispersing medium of the starting emulsion. The conversion of iodine to iodide does not occur instantaneously, but is usually observed to go to completion in a matter of minutes.

Upon iodine addition, the elemental iodine is converted to iodide ion by reacting the iodine with a mild reducing agent that is incapable of reducing (fogging) the grains (i.e., incapable of reducing $Ag^+$ to Ag° under the conditions of precipitation). The conversion of iodine to iodide is undertaken at a pH (preferably 3.5 to 8) that is sufficiently low to eliminate reduction fog. Preferably the pH is kept on the acid side of neutrality—that is, at a pH of <7.0. The removal of iodide ion from the dispersing medium in step (c) acts as a driving force for iodine reduction, allowing the water in the dispersing medium to act as the reducing agent for the step (b) conversion of iodine to iodide. Therefore no reducing agent stronger than water is required.

The iodine to iodide conversion can be monitored by observing the pH, since this reaction releases hydrogen ions into the dispersing medium. Preferably a base, such as sodium or potassium hydroxide, is added as required to maintain a constant pH. Slowing of the rate of base addition while maintaining a constant pH indicates that the iodine to iodide conversion is nearing completion.

Spontaneously, following the conversion of iodine to iodide, step (c) occurs. The iodide ions displace chloride ions from the high chloride {100} tabular grains. The chloride ions at the peripheral edges of the {100} tabular grains are more readily displaced than chloride ions elsewhere within the crystal lattice structure of the {100} tabular grains. Further, the chloride ions at the peripheral edges become progressively easier to displace with iodide ions approaching the corners of the grains. Since iodine releases iodide ions in a controlled manner, iodide ions are formed at a controlled rate that allows selective displacement of chloride ions at the peripheral edges and, with some care to control iodide ion delivery rates, chloride ion displacement by iodide ion can be guided toward the corners of the {100} tabular grains of the starting emulsion.

When iodide ion displaces chloride ion in the starting {100} tabular grains, chloride ion is released into the dispersing medium. This can be observed as a decline in the vAg of the dispersing medium. As the rate of iodide ion incorporation in the {100} tabular grains nears completion, the rate at which the vAg declines is observed to slow. To allow iodide displacement of chloride ion to go to completion, it is usually preferred to hold the emulsion for a few (typically 2 to 15) minutes following iodine addition. However, if iodine itself is added slowly to the dispersing medium, the iodine to iodide conversion followed by iodide displacement of chloride in the grain structure may be very nearly complete before the last of the iodine reaches the dispersing medium. In this instance, no further hold of the emulsion following termination of iodine addition is required before proceeding to step (2).

No verification has been obtained of the mechanism responsible for the crystal lattice dislocations formed in the high chloride {100} tabular grains during their further growth in step (2). It is possible that the iodine is first adsorbed onto the edges of the grains in elemental form, then reduced to iodide causing edge crystal lattice defects that grow into the crystal lattice dislocations when, during step (2), silver and other (including >50 mole % Cl) halide ions are made available in the dispersing medium for deposition onto the peripheral edges of the tabular grains being grown.

During step (2) silver and the other halide ions can be supplied from soluble salts or can be supplied from smaller grains, such as Lippmann grains, by Ostwald ripening. It is, of course, recognized that higher iodide concentrations than the maximum contemplated iodine concentrations named above in step (a) can be introduced into the grains during step (2) merely by adding iodide ions in any convenient conventional manner. For example, increased levels of iodide in the grains can be used to increase interimage effects and can be used to increase the native blue sensitivity of the grains. However, in most instances the maximum preferred levels of iodine addition are adequate to provide all of the iodide desired for imaging purposes at the peripheral edges of the high chloride {100} tabular grains.

It is possible to achieve the desired level of crystal lattice dislocations at the peripheral edges of the high chloride {100} tabular grains with very low amounts of additional grain growth. Silver additions during step (2) amounting to 0.5 or more (preferably at least 1.0) percent of silver in the starting (host) grains are contemplated. Large silver additions amounting to 30 percent or more of the silver in the starting emulsion are possible, but it is preferred to limit additional silver addition in step (2) to 20 (optimally 10) percent or less of total silver.

The product high chloride {100} tabular grain emulsions can have mean ECD's in any conventional range. Typically mean ECD's of 5.0 $\mu$m or less are preferred. The average aspect ratios, tabular grain thicknesses, and tabular grain projected areas are within the ranges described above in connection with the starting high chloride {100} tabular grain emulsions. Halide compositions are similar to those of the starting tabular grain emulsions, except for the iodide ion incorporated in steps (a–c), rendering iodide an essential rather than an optional halide inclusion. Since silver iodide is much less soluble than other silver halides, all of the iodide ion created in step (b) is incorporated into the grains, although a small part of the iodine added in step (a) may be lost by vaporization.

Emulsion sensitivity increases occur progressively as the proportion of the high chloride {100} tabular grains having 10 or more peripheral crystal lattice dislocations increases. In the product emulsions greater than 10 (preferably greater than 40 and optimally greater than 50) percent of the high chloride tabular grains having {100} major faces exhibit in the iodide containing peripheral region of the grains grown in step (2) 10 or more crystal lattice dislocations extending inwardly from the peripheral edges. As demonstrated in the Examples below, in some preparations the crystal lattice dislocations are distributed around the periphery of the tabular grains, and in other instances 10 are more crystal lattice dislocations are observed concentrated in the corner regions of the grains.

After a dislocation forms, it is propagated in subsequent crystal growth. Thus, all of the dislocations originating from crystal defects produced by steps (a–c) extend to the peripheral edge of the tabular grains. In high bromide {111} tabular grain emulsions, as reported by Black et al, cited above, crystal lattice dislocations have been observed both in central regions and peripheral regions of the tabular grains, with only the latter being thought to contribute to increased levels of sensitivity.

Once formed, the high chloride {100} tabular grain emulsions can be sensitized, combined with conventional photographic addenda, and coated in any conventional manner, as is further illustrated by the starting emulsion patents cited and incorporated by reference above.

Generally preparing the emulsions for use following precipitation begins with emulsion washing. This is in turn followed by chemical and spectral sensitization. Antifoggant and stabilizer addition is usually also undertaken. The emulsions are also combined with additional levels of vehicle before coating. Hardener is added to one or more vehicle layers just before coating. The emulsions are contemplated for use in both black-and-white (silver image forming) and color (dye image forming) photographic elements. The emulsions can be incorporated in radiographic and black-and-white photographic elements. The emulsions can also be incorporated in color print, color negative or color reversal elements. The following paragraphs of *Research Disclosure*, Vol. 389, September 1996, Item 38957, illustrate conventional photographic features compatible with the emulsions of the invention:

I. Emulsion grains and their preparation E. Blends, layers and performance categories II. Vehicles, vehicle extenders, vehicle-like addenda and vehicle related addenda III. Emulsion washing IV. Chemical sensitization V. Spectral sensitization and desensitization VII. Antifoggants and stabilizers IX. Coating physical property modifying addenda X. Dye image formers and modifiers XI. Layer arrangements XV. Supports XVIII. Chemical development systems

EXAMPLES

The invention can be better appreciated by reference to the following specific examples.

Host Emulsions

Two high chloride {100} tabular grain emulsions were used as host grain emulsions for the practice of the process of the invention. These emulsions were prepared using the procedure of Chang et al U.S. Pat. No. 5,413,904. The emulsions contained 0.04 mole % iodide, based on silver.

Emulsion HC-1 exhibited a mean grain ECD of 3.5 $\mu$m and a mean tabular grain thickness of 0.18 $\mu$m. The tabular grain projected area was 93% of the total grain projected area.

Emulsion HC-2 exhibited a mean grain ECD of 2.7 $\mu$m and a mean tabular grain thickness of 0. 13 $\mu$m. The tabular grain projected area was 84% of the total grain projected area.

Emulsion 1 1.0 mole % Elemental Iodine 70° C. Treated (Example) High Chloride {100} Tabular Grain Emulsion A vigorously stirred reaction vessel containing 0.20 mole Emulsion HC-1, 8.8 mmole sodium dihydrogen phosphate and distilled water to 400 g at 70° C. was adjusted to a vAg of 197 mV (pCl of 2.30) and pH of 6.5. Then 2.2 mmole of elemental iodine dissolved in 10 mL of ethanol was added at the rate of 1.0 mL per min. After the completion of the addition of the iodine solution, the mixture was stirred for one minute (pH had dropped to 5.8 and the vAg to 176 mV). Then a 1M $AgNO_3$ solution was added at 1.0 mL per min and a 1.08M NaCl solution was added at a rate needed to maintain the vAg at 175 mV until 0.020 mole of silver had been added.

The resulting high chloride {100} tabular grain emulsion exhibited a mean grain ECD of 3.6 μm and a mean tabular grain thickness of 0.19 μm. Tabular grain projected area was 93% of the total grain projected area.

Tabular grain analysis by analytical electron microscopy showed that the iodide content was 2 to 6 mole %, based on silver, at the corners and edges and was below the detection limit of the microscope (less than 0.5 mole %) elsewhere.

Analysis of the tabular grains by transmission electron microscopy revealed that 76% of the tabular grains contained 10 or more peripheral crystal lattice dislocations within their peripheral regions. These dislocations appeared as lines intersecting the tabular grain edges. A typical grain is shown in FIG. 1.

The percentage of the tabular grains containing 10 or more peripheral crystal lattice dislocations is summarized in Table I.

Emulsion 2 70° C. KI Treated Emulsion
(Comparison)

This emulsion was prepared similarly to Emulsion 1, except that 10 mL of an aqueous solution containing 2.2 mmole of KI was used instead of the ethanolic iodine solution. One minute after the completion of the addition of the KI solution, the vAg was 173 mV.

The resulting high chloride {100} tabular grain emulsion exhibited a mean grain ECD of 3.7 μm and a mean tabular grain thickness of 0.18 μm. Tabular grain projected area was 93% of the total grain projected area.

Analysis of the tabular grains by transmission electron microscopy revealed that none of the tabular grains exhibited 10 or more crystal lattice dislocations in their peripheral region.

The results are summarized in Table I.

Emulsion 3 35° C. Iodine Treated Emulsion
(Example)

A vigorously stirred reaction vessel containing 0.20 mole Emulsion HC-1, 8.8 mmole sodium dihydrogen phosphate and distilled water to 400 g at 35° C. was adjusted to a vAg of 123 mV. (pCl of 1.41) and pH of 6.5. Then 2.2 mmole of elemental iodine dissolved in 10 mL of ethanol was added at the rate of 1.0 mL per min. One minute after the completion of the addition of the iodine solution, the pH was 5.9 and the vAg was 117 mV. The temperature was then increased to 70° C. in 21 min, then a 1M $AgNO_3$ solution was added at 1.0 mL per min and a 1.08M NaCl solution was added at a rate needed to achieve and then maintain a vAg at 175 mV.

The resulting high chloride {100} tabular grain emulsion exhibited a mean grain ECD of 3.7 μm and a mean tabular grain thickness of 0.18 μm. Tabular grain projected area was 93% of the total grain projected area.

Figure 2:
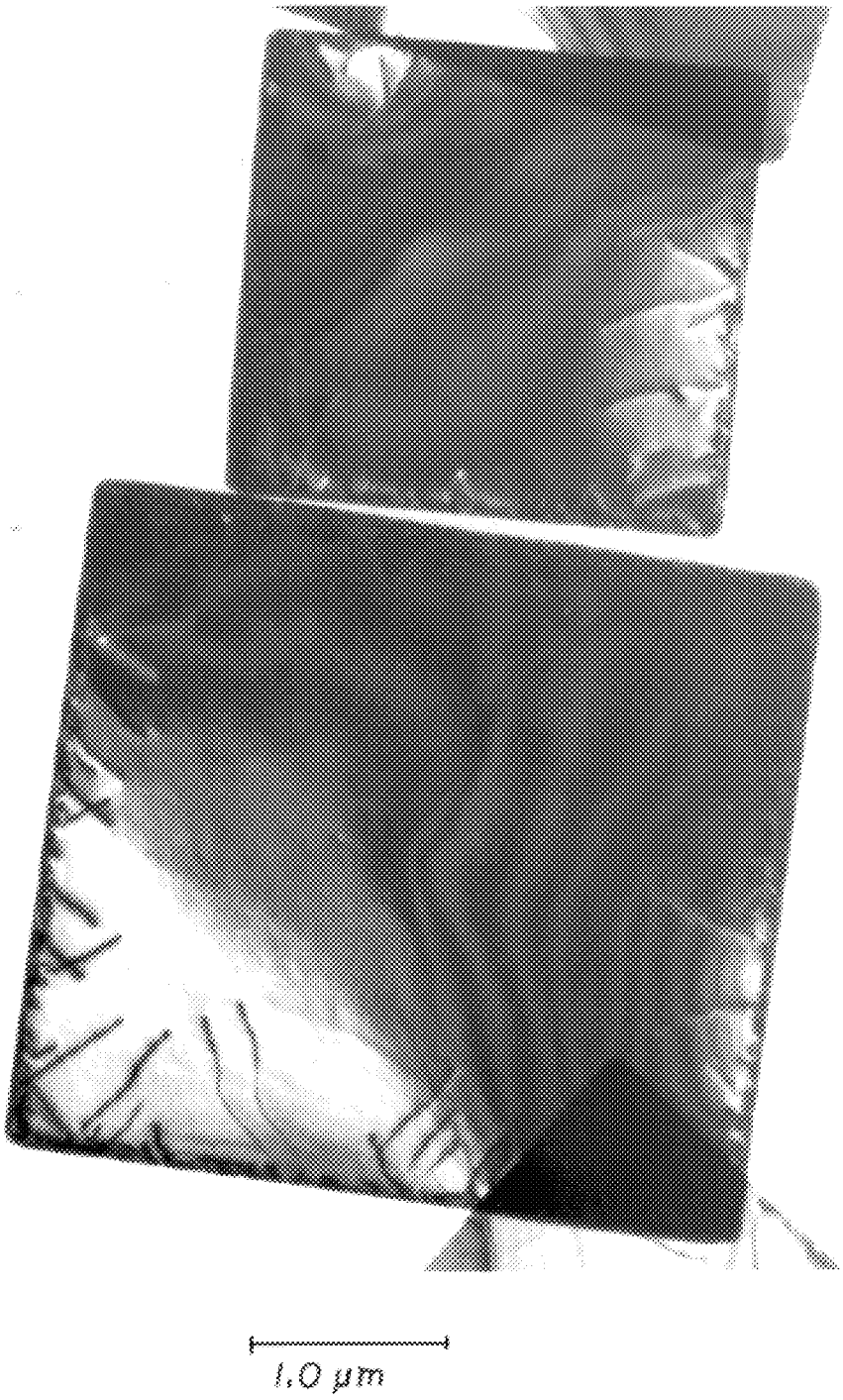
Figure 3:
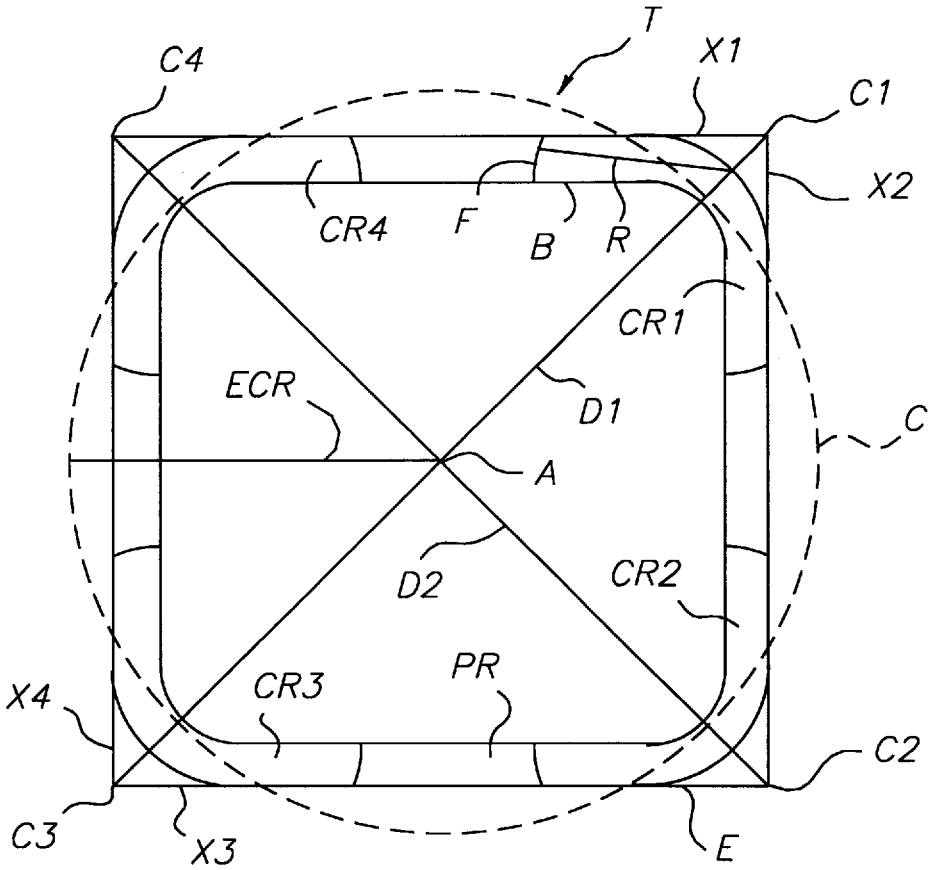
FIG. 3 depicts a high chloride {100} tabular grain viewed perpendicular to one major face.

Analysis of the tabular grains by transmission electron microscopy revealed that the 60% of the tabular grains exhibited 10 or more crystal lattice dislocations within their peripheral regions. These dislocations appeared as lines intersecting the tabular grain edges. A typical grain is shown in FIG. 2.

Emulsion 4 70° C. Rapid Addition of
(Example) Iodine Treated Emulsion

This emulsion was prepared similarly to Emulsion 1, except that 2.2 mmole of elemental iodine dissolved in 2 mL of dimethylformamide was added in 2 sec. to a strongly mixed region of the vessel contents. (One minute after the completion of the addition, the pH was 5.8 and the vAg was 174 mV.)

The resulting high chloride {100} tabular grain emulsion exhibited a mean grain ECD of 3.6 μm and a mean tabular grain thickness of 0.19 μm. Tabular grain projected area was 93% of the total grain projected area.

Analysis of the tabular grains by transmission electron microscopy revealed that 42% of the tabular grains exhibited 10 or more crystal lattice dislocations in their peripheral regions. These dislocations appeared as lines intersecting the tabular grain edges.

Emulsion 5 0.22 mole % Iodine 70° C. Treated Emulsion.
(Example)

This emulsion was prepared similarly to Emulsion 1, except that 0.44 mmole of iodine dissolved in 2 mL of dimethylformamide was added in 2 sec.

The resulting high chloride {100} tabular grain emulsion exhibited a mean grain ECD of 3.7 μm and a mean tabular grain thickness of 0.18 μm. Tabular grain projected area was 93% of the total grain projected area.

Analysis of the tabular grains by transmission electron microscopy revealed that 11 percent of the tabular grains exhibited 10 or more crystal lattice dislocations in their peripheral regions.

This emulsion is listed below in Table I, which summarizes results.

Emulsion 6 35° C., pH 6.5, Iodine Treated Emulsion,
(Example) With Overgrowth at 35° C.

A vigorously stirred reaction vessel containing 0.20 mole Emulsion HC-1, 8.8 mmole sodium dihydrogen phosphate and distilled water to 400 g at 35° C. was adjusted to a vAg of 123 mV (pCl of 1.41) and pH of 6.5. Then 2.2 mmole of elemental iodine dissolved in 10 mL of methanol were added at the rate of 1.0 mL per min. After the completion of the addition of the iodine solution, the mixture was stirred for 10 minutes (the pH had dropped to 5.9 and the vAg to 117 mV). Then a 1M $AgNO_3$ solution was added at 1.0 mL per min and a 1.08M NaCl solution was added at a rate needed to maintain the vAg at 123 mV until 0.020 mole of silver had been added.

The resulting high chloride {100} tabular grain emulsion exhibited a mean grain ECD of 3.6 μm and a mean tabular grain thickness of 0.19 μm. Tabular grain projected area was 93% of the total grain projected area.

Analysis of the tabular grains by transmission electron microscopy revealed that 95 percent of the tabular grains exhibited 10 or more crystal lattice dislocations in their peripheral regions.

Emulsion 7 35° C., pH 4.0, Iodine Treated Emulsion,
(Example) Slower Iodide Release Rate.

A vigorously stirred reaction vessel containing 0.2 mole Emulsion HC-2, 20 mmole potassium hydrogen phthalate and distilled water to 400 g at 35° C. was adjusted to a vAg of 140 mV and pH of 4.0. Then 2.2 mmole of elemental iodine dissolved in 2 mL of dimethylformamide was added in 2 sec to a strongly mixed region of the vessel contents. One minute after the completion of the addition of the iodine solution, the pH was 3.91 and the vAg was 134 mV. Then the temperature was raised to 70° C. at a rate of 5° C. per min. After 1 min at 70° C., a 1M $AgNO_3$ solution was added at 1.0 mL per min and a 1.08M NaCl solution was added at a rate needed to achieve and then to maintain a vAg at 175 mV.

The resulting high chloride {100} tabular grain emulsion exhibited a mean grain ECD of 2.5 μm and a mean tabular grain thickness of 0.15 μm. Tabular grain projected area was 85% of the total grain projected area.

Analysis of the tabular grains by transmission electron microscopy revealed that all of the tabular grains examined exhibited 10 or more crystal lattice dislocations in their peripheral regions.

Emulsion 8 High Chloride Grains With 9 mole % Shell (Comparison) Produced by the Homogeneous Addition of 7 mole % Iodine, Total Overall Iodide 0.68 mole %.

To a vigorously stirred reaction vessel containing 0.2 mole Emulsion HC-1 and distilled water to 400 g at 60° C., vAg of 165 mV (pCl=1.89), and pH of 5.7 were added 1.0M $AgNO_3$ solution at 1.0 mL per min, 0.0787M KI solution at 0.89 mL per min, and a 1.0M NaCl solution at a rate needed to maintain the vAg of 165 mV until 20 mmole of silver and 1.4 mmole of iodide were added.

The resulting high chloride {100} tabular grain emulsion exhibited a mean grain ECD of 3.7 μm and a mean tabular grain thickness of 0.18 μm. Tabular grain projected area was 93% of the total grain projected area.

Analysis of the tabular grains by transmission electron microscopy revealed that none of the tabular grains exhibited 10 or more crystal lattice dislocations at their corners and edges.

The results are summarized in Table I.

Emulsion 9 Emulsion E of Brust et al U.S. Pat. No. 5,314,798, AgICL {100} Tabular (Comparison) Grain Emulsion Having Shell Made Using 1.1 mole % KI A 1.5 L solution containing 3.52% by weight of low methionine gelatin, 0.0056M sodium chloride and 0.3 mL of polyethylene glycol antifoamant was provided in a stirred reaction vessel at 40° C. While the solution was vigorously stirred, 45 mL of a 0.01M potassium iodide solution were added. This was followed by the addition of 50 mL of 1.25M silver nitrate and 50 mL of a 1.25M sodium chloride solution added simultaneously at a rate of 100 mL per min each. The mixture was then held for 10 sec with the temperature remaining at 40° C. Following the hold, a 0.625M silver nitrate solution containing 0.08 mg mercuric chloride per mole of silver nitrate and a 0.625M sodium chloride solution were added simultaneously each at 10 mL per min for 30 min followed by a linear acceleration from 10 mL per min to 15 mL per min over 125 min. The pCl was adjusted to 1.6 by running the 1.25M sodium chloride solution at 20 mL per min for 8 min. This was followed by a 10 min hold then the addition of the 1.25M silver nitrate solution at 5 mL per min for 30 min. This was followed by the addition of 32 mL of 0.5M potassium iodide and a 20 min hold. Following the hold, the 0.625M silver nitrate and the 0.625M sodium chloride solution were added simultaneously each at 15 mL per min for 10 min. The pCl was then adjusted to 1.6. Then 50 g of phthalated gelatin were added, and the emulsion was washed and concentrated using the procedures of Yutzy et. al. U.S. Pat. No. 2,614,918.

The resulting high chloride {100} tabular grain emulsion exhibited a mean grain ECD of 1.8 μm and a mean tabular grain thickness of 0.13 μm. Tabular grain projected area was 75% of the total grain projected area.

Analysis of the tabular grains by transmission electron microscopy revealed that none of the tabular grains exhibited 10 or more crystal lattice dislocations at their corners and edges.

TABLE I

Peripheral Dislocations of High Chloride {100} Tabular Grain Emulsions Determined by Transmission Electron Microscopy

| Example or (Comparison) | Iodide source | % Tabular grains with 10 or more peripheral dislocations |
|---|---|---|
| 1 | Iodine | 76% |
| (2) | KI | 0% |
| 3 | Iodine | 60% |
| 4 | Iodine | 42% |
| 5 | Iodine | 11% |
| 6 | Iodine | 95% |
| 7 | Iodine | 100% |
| (8) | KI | 0% |
| (9) | KI | 0% |

The invention has been described in detail with particular reference to preferred embodiments thereof, but it will be understood that variations and modifications can be effected within the spirit and scope of the invention.

What is claimed is:

1. A process of preparing a tabular grain emulsion comprised of the steps of (1) providing an emulsion comprised of a dispersing medium and radiation-sensitive silver halide host grains in which (i) the radiation-sensitive silver halide host grains contain greater than 50 mole percent chloride, based on silver, and (ii) greater than 50 percent of host grain projected area is accounted for by tabular host grains having parallel {100} major faces, and (2) extending lateral growth of the {100} major surfaces of the tabular host grains by precipitating additional silver halide containing greater than 50 mole percent chloride, based on silver, to form product tabular grains with {100} major faces extending to peripheral edges of the product tabular grains, WHEREIN, prior to step (2), (a) elemental iodine is introduced into the dispersing medium, (b) the iodine is converted to iodide, and (c) the iodide is incorporated into the host tabular grains at their peripheral edges by chloride ion displacement, to create in step (2) 10 or more crystal lattice dislocations extending inwardly from the peripheral edges of greater than 10 percent of the product tabular grains having {100} major faces.

2. A process according to claim 1 wherein the host grains account for greater than 70 percent of total grain projected area.

3. A process according to claim 1 wherein the host grains contain greater than 90 mole percent chloride, based on silver.

4. A process according to claim 1 wherein the 10 or more crystal lattice dislocations extend inwardly from the peripheral edges of more than 40 percent of the product tabular grains having {100} major faces.

5. A process according to claim 1 wherein greater than 0.1 mole percent iodine is added, based on silver added in step (1).

6. A process according to claim 5 wherein from 0.2 to 5 mole percent iodine is added based on silver added in step (1).

7. A radiation-sensitive emulsion comprised of a dispersing medium and radiation-sensitive silver halide grains

WHEREIN the radiation-sensitive silver halide grains contain greater than 50 mole percent chloride, based on silver, greater than 50 percent of total grain projected area is accounted for by tabular grains having parallel {100} major faces extending to their peripheral edges, and greater than 10 percent of the tabular grains having {100} major faces include in an iodide containing peripheral region 10 or more crystal lattice dislocations extending inwardly from peripheral edges of the {100} major faces.

8. A process according to claim 7 wherein the grains account for greater than 70 percent of total grain projected area.

9. A process according to claim 7 wherein the grains contain greater than 90 mole percent chloride, based on silver.

10. A radiation-sensitive emulsion according to claim 7 wherein greater than 40 percent of the tabular grains having {100} major faces include in an iodide containing peripheral region 10 or more crystal lattice dislocations extending inwardly from peripheral edges of the {100} major faces.

11. A radiation-sensitive emulsion according to claim 7 wherein the crystal lattice dislocations lie within corner regions of the tabular grains.

* * * * *